US008869544B2

(12) United States Patent
Bernal

(10) Patent No.: US 8,869,544 B2
(45) Date of Patent: Oct. 28, 2014

(54) APPARATUS AND METHOD FOR COOLING CONTAINERS

(75) Inventor: Andres Bernal, Sunny Isles Beach, FL (US)

(73) Assignee: Andres Bernal, Sunny Isles Beach, FL (US)

( * ) Notice: Subject to any disclaimer, the term of this patent is extended or adjusted under 35 U.S.C. 154(b) by 275 days.

(21) Appl. No.: 13/545,346

(22) Filed: Jul. 10, 2012

(65) Prior Publication Data

US 2014/0014293 A1 Jan. 16, 2014

(51) Int. Cl.
*F25D 25/00* (2006.01)

(52) U.S. Cl.
USPC ..... 62/62; 62/70; 62/371

(58) Field of Classification Search
CPC ..... F28F 1/00; F28F 7/00; F28F 9/00; F28F 13/00; F28F 25/00
USPC ..... 62/62, 70, 371, 457.3, 314; 165/53, 57
See application file for complete search history.

(56) References Cited

U.S. PATENT DOCUMENTS 2,849,079 A * 8/1958 Evans ..... 55/392
3,848,661 A * 11/1974 Palm et al. ..... 165/155
4,194,371 A * 3/1980 Morse ..... 62/503
4,715,195 A 12/1987 Kucza
5,331,817 A * 7/1994 Anthony ..... 62/5
5,500,134 A * 3/1996 Chahine ..... 210/787
5,505,054 A 4/1996 Loibl et al.
5,765,394 A * 6/1998 Rhoades ..... 62/603
6,109,041 A * 8/2000 Mitchell et al. ..... 62/6
6,314,751 B1 11/2001 Gjersvik
6,397,624 B1 6/2002 Horwell
6,662,574 B2 12/2003 Loibl et al.
7,201,000 B2 4/2007 Kurkaev et al.
8,136,618 B2 * 3/2012 Field ..... 180/68.1
8,453,882 B2 * 6/2013 Johnson ..... 222/146.6
2006/0185372 A1 8/2006 Conde Hinojosa
2009/0000312 A1 1/2009 Smith et al.
2010/0282777 A1 * 11/2010 Johnson ..... 222/146.6
2010/0319363 A1 12/2010 Dieckmann

* cited by examiner

*Primary Examiner* — Mohammad M Ali
(74) *Attorney, Agent, or Firm* — Novak Druce Connolly Bove + Quigg LLP

(57) ABSTRACT

An apparatus for cooling containers includes a cooling chamber having a side wall with a circular interior surface defining a cylindrical interior chamber cavity. The interior chamber cavity has a diameter and length sufficient to receive the container therein, and an open top permitting insertion of the container and egress of the fluid. At least one fluid inlet is positioned so as to inject a cooling fluid tangential to the circular side wall. At least one fluid outlet is provided for removing the cooling fluid from the cooling chamber. A method for cooling containers is also disclosed.

14 Claims, 15 Drawing Sheets

APPARATUS AND METHOD FOR COOLING CONTAINERS

FIELD OF THE INVENTION

The invention relates to the field of chillers or heat exchangers, and more specifically for chillers and heat exchangers for cooling containers and particularly beverage containers for such products as sodas and beer.

BACKGROUND

There are four main methods of heat exchange. These are radiation, conduction, convection, and evaporation. Evaporation is a very efficient cooling method. Convection is the heat transfer associated with the movement of mass across a thermal boundary. More specific, it relates to the flow of a fluid (coolant) past a solid boundary. Natural convection is convection caused by the motion and mixing caused by density variations within the fluid. Forced convection is the term used when this flow is caused by an outside force, such as a pump. The factors that affect convection efficiency include fluid velocity, fluid viscosity, and fluid heat capacity.

SUMMARY OF THE INVENTION

An apparatus for cooling containers includes a cooling chamber having a side wall with a circular interior surface defining a cylindrical interior chamber cavity. The interior chamber cavity has a diameter and length sufficient to receive the container therein, and an open top permitting insertion of the container and egress of the fluid. At least one fluid inlet is positioned so as to inject a cooling fluid tangential to the circular side wall. At least one fluid outlet is provided for removing the cooling fluid from the cooling chamber.

The cooling chamber can be cylindrical and a plurality of fluid inlets can be disposed along a length of the cooling chamber. The plurality of inlets can be substantially vertically aligned. At least one input manifold can be provided for supplying cooling fluid to the plurality of inlets. The cooling chamber can be cylindrical. At least one fluid outlet can be a lower outlet at a bottom portion of the cooling chamber. A fluid valve can be provided in fluid communication with the lower outlet for controlling the flow rate of fluid through the lower outlet.

A catchment container can be provided for collecting fluid from the open topped fluid outlet, and dispensing the fluid through at least one catchment outlet. The apparatus can have at least one cooling fluid reservoir. The apparatus can have at least one fluid pump. A heat exchanger can be provided for altering (raising or lowering) the temperature of the cooling fluid according to whether the container is being cooled or heated. A controller can control at least one of the flow rate of cooling fluid through the fluid inlet and the flow rate of fluid through the fluid outlet.

A method for cooling containers can include the steps of placing the container in a cooling chamber having a circular side wall defining an interior chamber cavity. The interior chamber cavity has a diameter and length sufficient to receive the container therein, and an open top permitting insertion of the container and egress of the fluid. A cooling fluid is injected into the cooling chamber tangentially to the circular side wall. The cooling fluid is removed from the open top of the cooling chamber and also from a lower fluid outlet.

BRIEF DESCRIPTION OF THE DRAWINGS

There are shown in the drawings embodiments that are presently preferred it being understood, however, that the invention is not limited to the precise arrangements and instrumentalities shown, wherein.

DETAILED DESCRIPTION OF THE INVENTION

Figure 1:
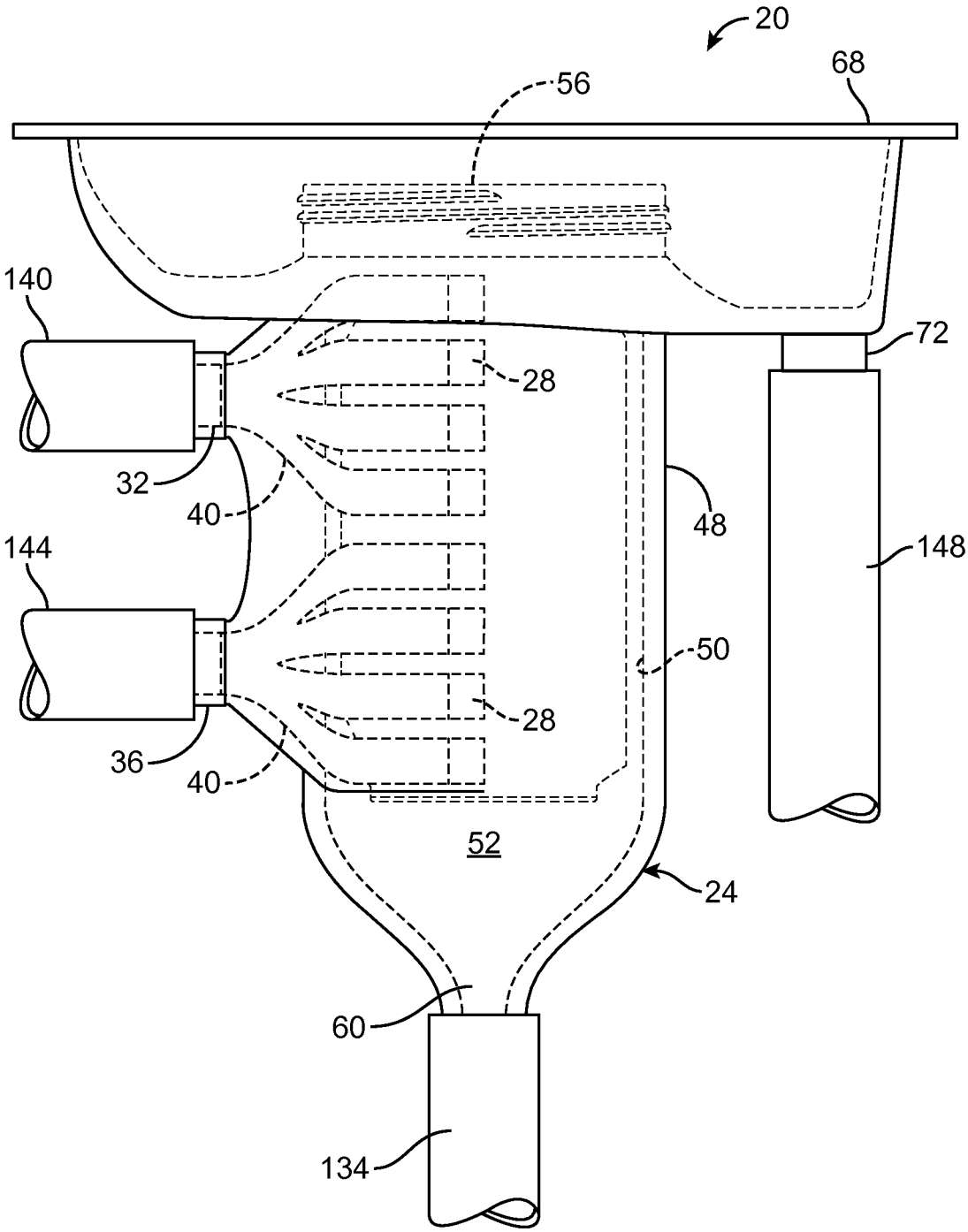
FIG. 1 is a side elevation, partially in phantom, of an apparatus for cooling containers.
Figure 2:
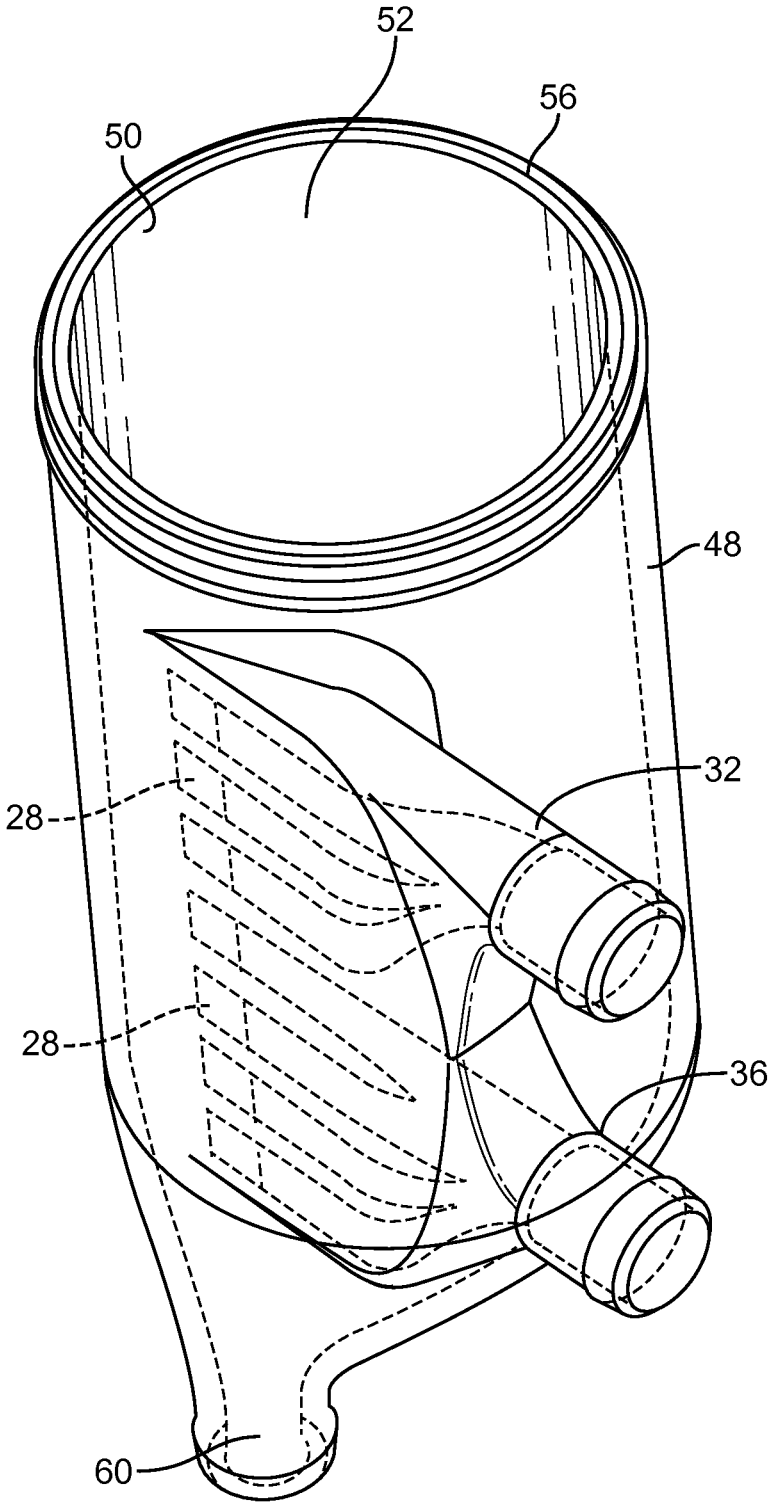
FIG. 2 is a perspective view, partially in phantom, of a cooling chamber.

There is shown in the drawings an apparatus 20 for chilling containers. The apparatus 20 includes a cooling chamber 24 having at least one cooling fluid inlet 28. The cooling chamber 24 has a side wall 48 having a circular interior surface 50 defining a cylindrical interior chamber cavity 52. The interior chamber cavity 52 has a length and diameter sufficient to receive the container that is to be chilled. An open top 56 permits the insertion and removal of the container into the interior chamber cavity 52, and also permits the egress of cooling fluid. The open top 56 has a cross sectional area that is the same and the cross sectional area of the interior chamber cavity 52, or nearly the same for example, within 5, 10 or 20%. The cooling fluid inlet 28 is positioned so as to inject a cooling fluid tangential to the circular side wall surface 50.

A plurality of inlets 28 can be provided to dispense the cooling fluid across the length of the cooling chamber. An inlet port 32 can be provided to supply cooling fluid to the inlets 28. The inlet port 32 can communicate with a manifold 40 for distributing cooling fluid to the plurality of inlets 28. One or more additional inlet ports 36 can be provided and can also communicate with a manifold 40 for distributing the cooling fluid to the inlet ports 28.

The cooling fluid can exit the cooling chamber 24 through the open top 56 and through one or more additional fluid outlets. At least one lower fluid outlet is provided at or near the bottom of the cooling chamber 24, below the position of the container when a container is in the cooling chamber 24. A lower fluid outlet 60 is shown substantially at the bottom of the cooling chamber 24. Other positions for the lower outlet are possible.

Cooling fluid flowing out of the open top 56 must be collected. A catchment container 68 can be provided for this purpose. The catchment container 68 can have many different sizes and designs. In the embodiment shown, the catchment container 68 surrounds the open top 56 of the cooling chamber 24 such that cooling fluid will flow out of the open top 56 and into the catchment container 68. An outlet 72 can be provided in the catchment container 68 such that the cooling fluid 68 will flow through the outlet 72. The flow through the outlet 72 can be by gravity or with the assistance of a pump.

Figure 3:
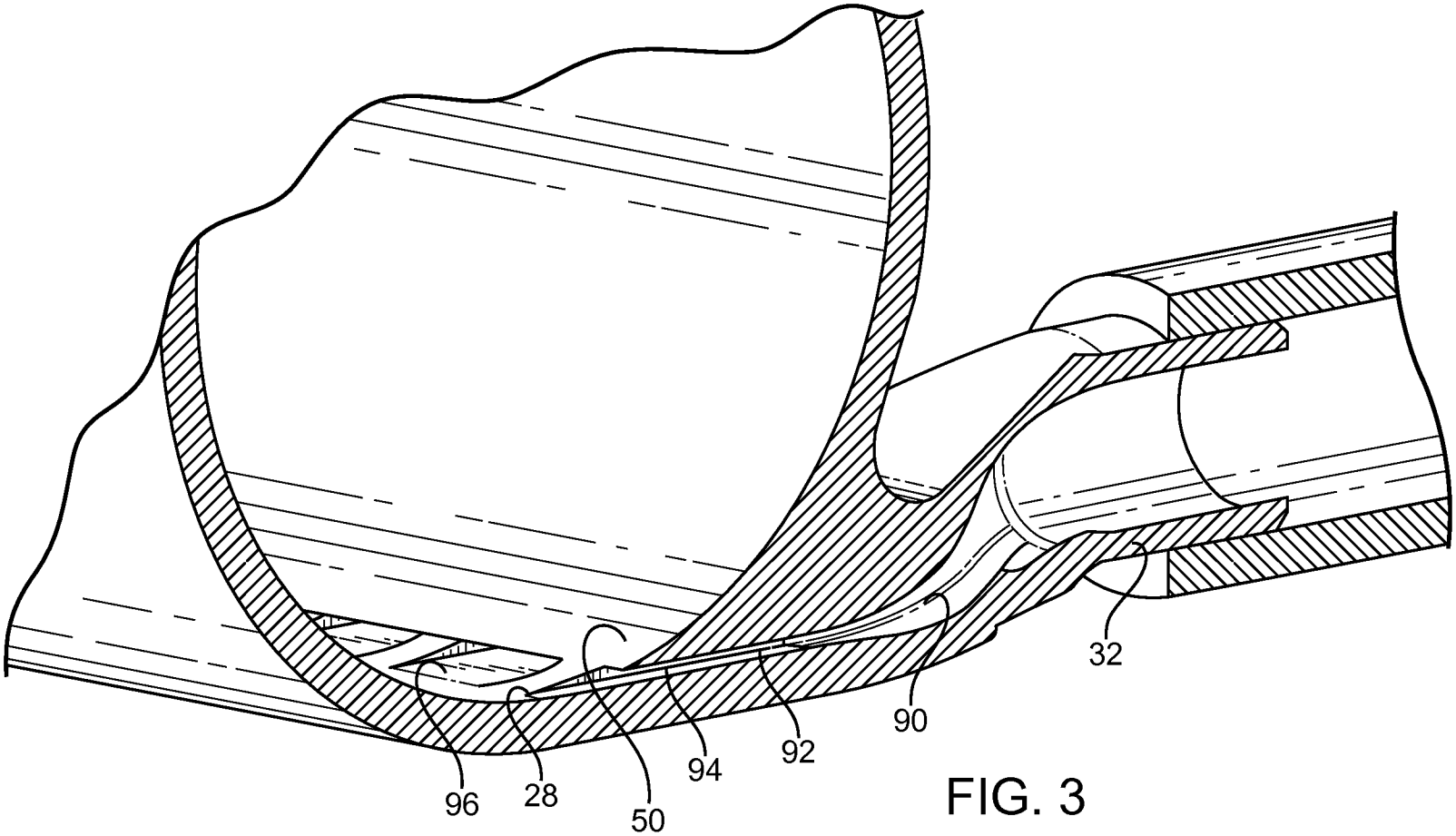
FIG. 3 is a cross section of a fluid inlet into the cooling chamber.
Figure 4:
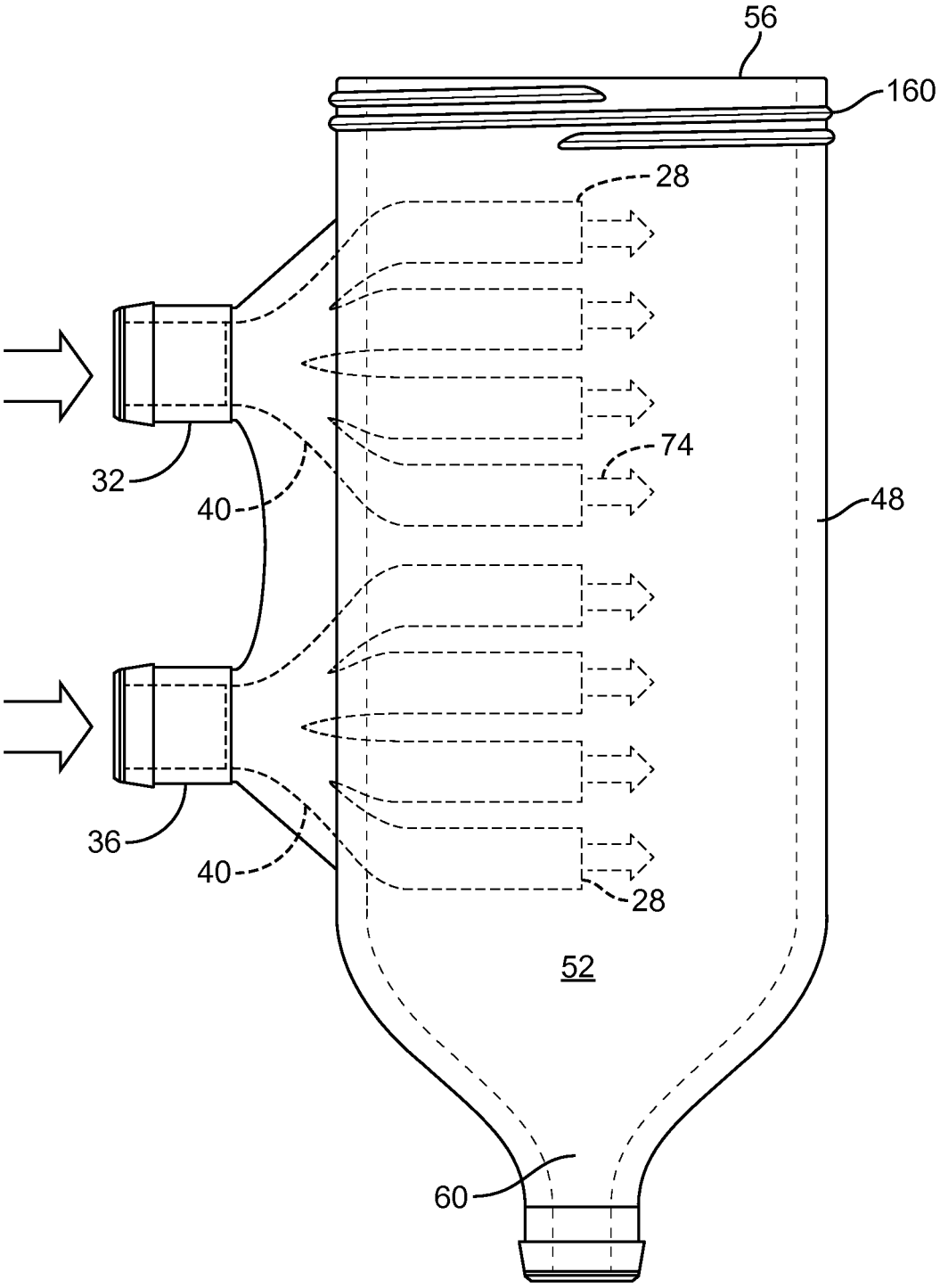
FIG. 4 is a side elevation, partially in phantom, of fluid flows into the cooling chamber.

The shape, size and design of the outlets 28 can vary. There is shown in FIG. 3 a design of an outlet 28 where cooling fluid is received from the inlet port 32. A reducing diameter portion 90 gradually reduces the cross sectional area of the fluid flow path to increase the velocity of the fluid flow at the outlet 28. An extended reduced cross sectional area neck portion 92 can reduce the turbulence in the fluid flow stream. The outlet 28 can be positioned in a scalloped outlet seat 96 that is formed in the inside surface 50 of the cooling chamber wall 48. The outlet opening can be of different shapes but can be rectangular and having a length that is greater than the width. The cooling fluid exiting the outlet will have significant velocity.

The cooling fluid can be any suitable fluid. The cooling fluid can be water. The cooling fluid can be a gas such as air or another gas. In the event that the cooling fluid is a gas the system will have to be hermetic to prevent the escape of the gas such that the gas can be recirculated.

Figure 5:
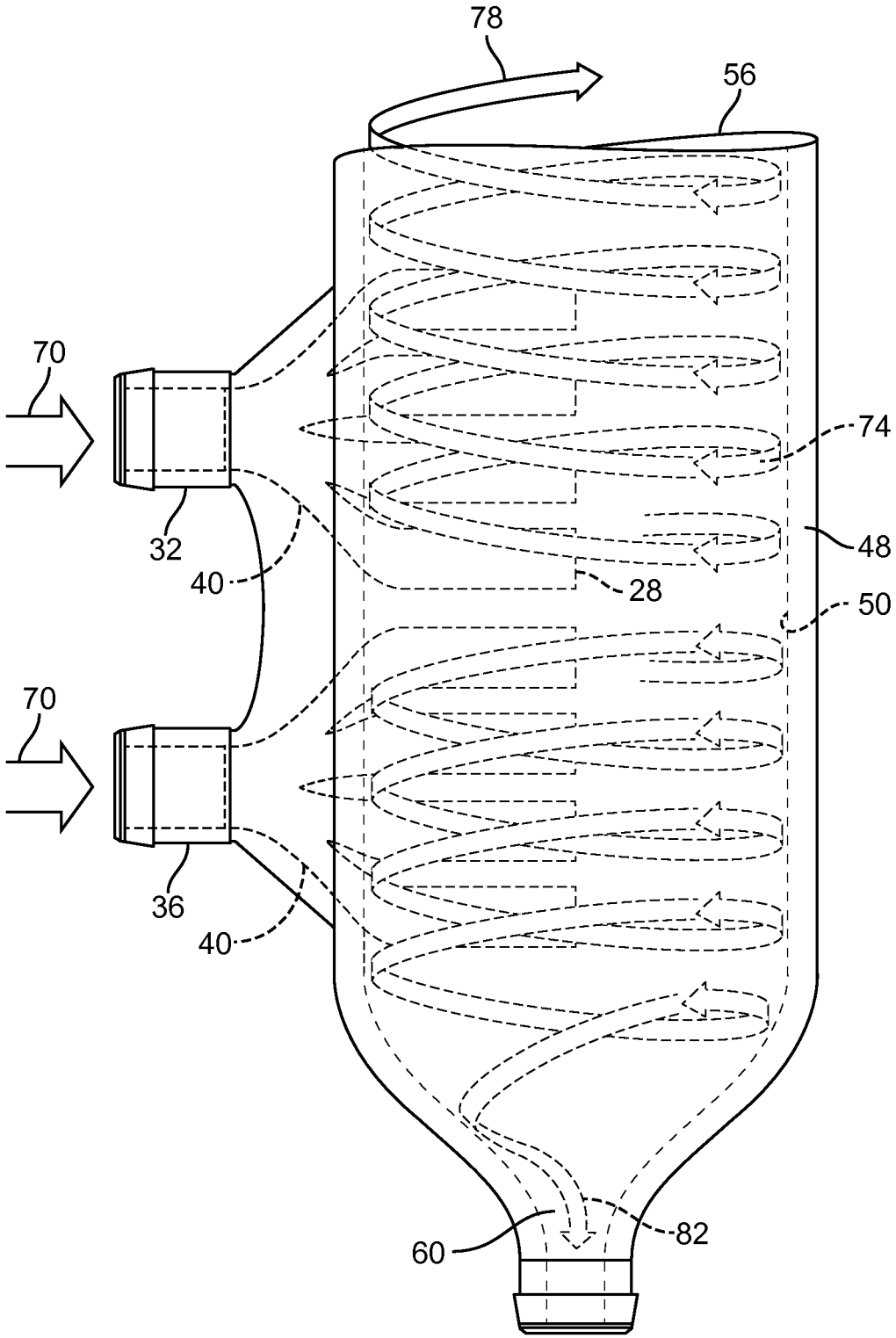
FIG. 5 is a side elevation, partially in phantom, of fluid flows through the cooling chamber.
Figure 6A:
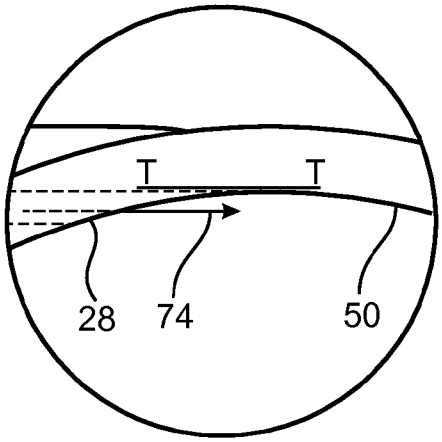
FIG. 6A is a magnified plan view of a fluid inlet.
Figure 6:
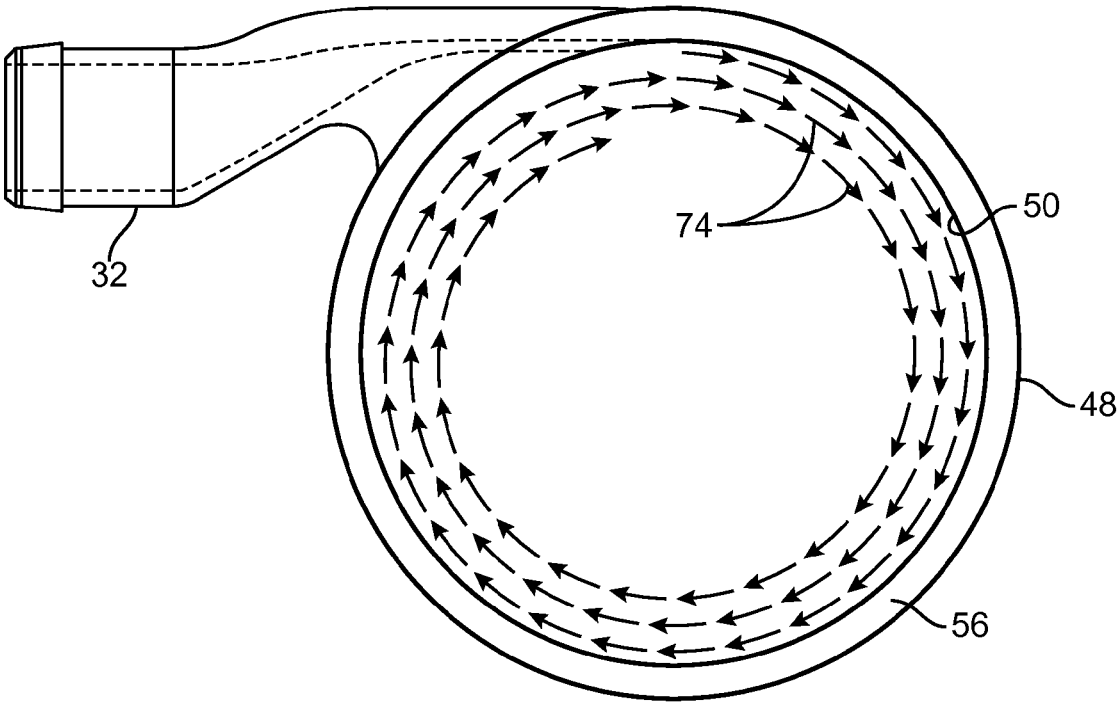
FIG. 6 is a plan view of the cooling chamber illustrating fluid flows within the cooling chamber.

The flow of cooling fluid through the cooling chamber 24 is illustrated in FIGS. 5-6. The flow from the outlet 28 will be substantially tangential to the inside surface 50 of the wall 48. The term tangential as used herein means that the direction of the fluid flow leaving the outlets 28, when taken against a tangent T-T of the adjacent inside surface 50 of the wall 48, is no more than ±1, +2, ±3, ±4, ±5, ±10, ±15, ±20, ±25, or ±30 degrees (FIG. 6).

The cooling fluid is introduced tangentially relative to the inside surface 50 and follows the surface 50 in a swirling vortex as shown by the arrows 74 (FIG. 5). The cooling fluid traverses the inside surface 50 in a helical path to exit the open top 56 as shown by the arrow 78, and the lower outlet 60 as shown by the arrow 82.

The invention can be used with different containers. The container can be cylindrical, or can be non-cylindrical. The container can be radially uniform, such that at any given height the container has a substantially circular circumference. The container can have different cross sections at different heights, as in a non-cylindrical can or in a beverage bottle. An example of a suitable container is an aluminum or alloy beverage can as are used commonly for sodas and beer. Bottles of glass, plastic, or other materials can also be used. A container specifically for the invention can be provided to chill liquids or other materials that are not packaged in suitable containers. Such a special purpose container can be reusable. The container must be dimensioned such that sufficient space is provided to permit the flow of cooling fluid about the container within the cooling chamber.

Figure 7:
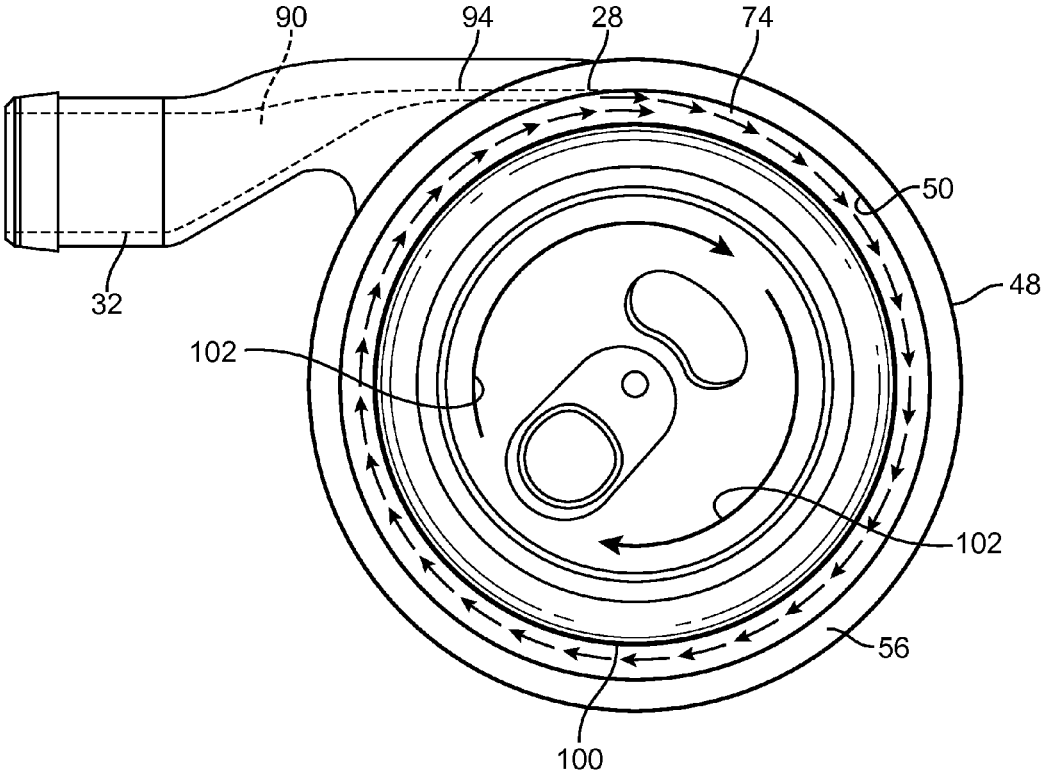
FIG. 7 is a plan view of the cooling chamber having a container therein and illustrating fluid flows around the container.
Figure 8A:
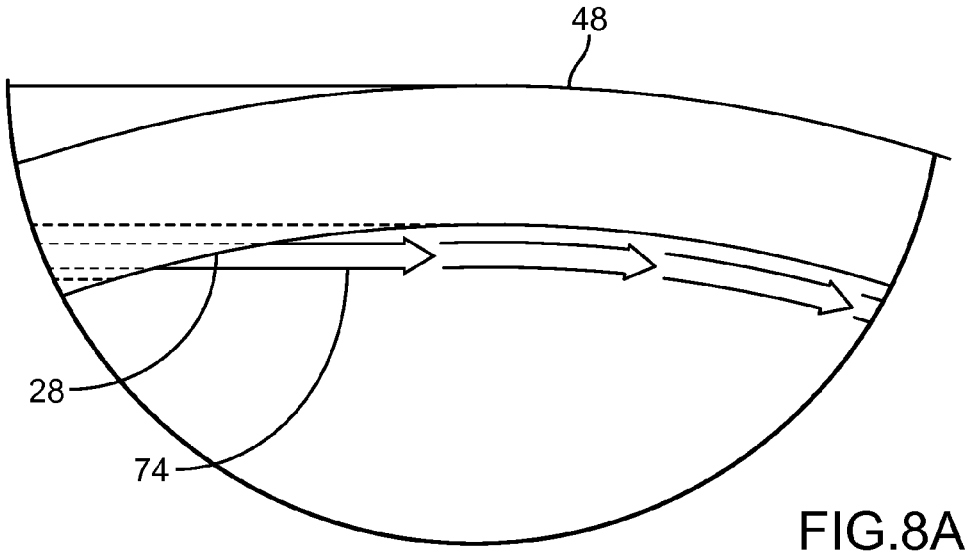
FIGS. 8A-B are A) a magnified plan view, partially in phantom, and B) a cross section illustrating fluid flow in the cooling chamber and around the container.
Figure 8B:
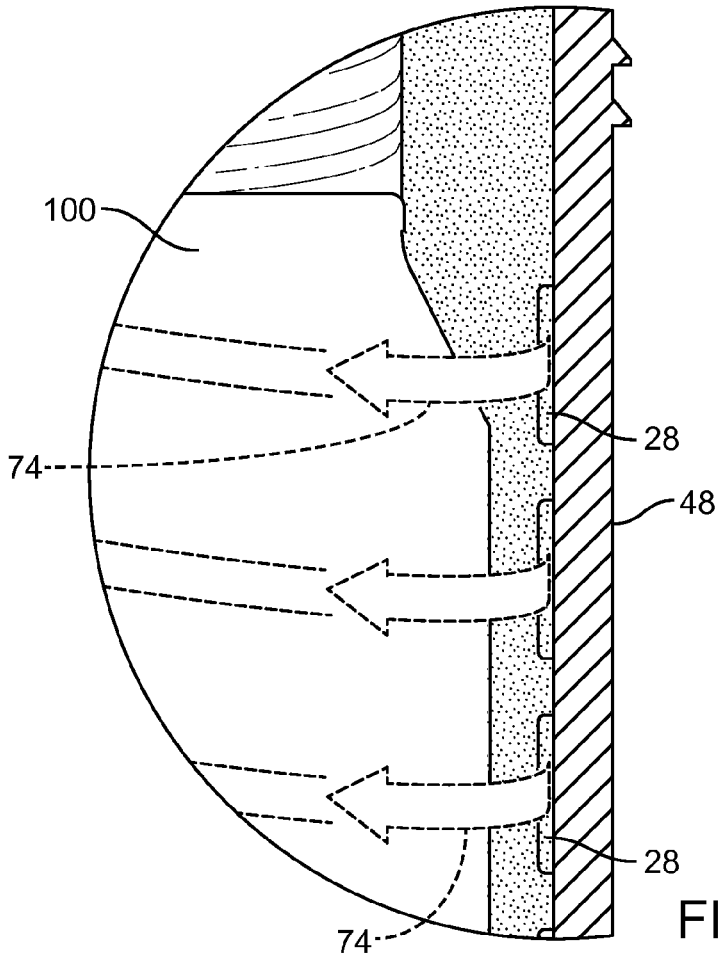

A container 100 in the form of an aluminum can is shown as an example in FIGS. 7-8. The can 100 is placed into the cooling chamber through the open top 56. Circulating cooling fluid flows tangentially upon exiting the outlet 28, as shown by arrows 74. The circulating fluid contacts the can 100 or other container and imparts a rotational force to the can 100. The rotational force causes rotation of the can 100 as indicated by the arrows 102. The cooling fluid flows upward and downward in a helical manner about the can 100 as shown schematically by the arrows 74. As the lower outlet 60 can have a smaller cross sectional area than that of the cavity 52, such as less than ½ or ¼, a whirlpool or vortex is formed as the cooling fluid flows to and through the lower outlet 60. As the centrifugal force drives the cooling fluid outward against the inside surface 50 an open space 108 can be formed above the container 100.

The contacting of the can 100 by the cooling fluid causes a convective heat transfer which cools or heats the can. The rotation of the can insures that all surfaces about the circumference of the can are contacted by the cooling fluid. The rotation of the can or container also has the effect of circulating and mixing the contents of the container.

The process of cooling a container is illustrated in FIGS. 9 A-C. The container 100 is placed into the cavity 52 of the cooling chamber 24 through the open top 56. The circulating cooling fluid shown by arrows 74 rotates the container 100 and moves upward through the cavity 52 and out the open top 56, or downward and out the lower outlet 60. The portion 112 of the cooling fluid exiting the open top 56 is collected in catchment container 68. The cooling fluid can flow out of the catchment container through a suitable outlet 72. The outlet 72 can communicate with a suitable fluid outlet conduit 148 to conduct the exiting fluid stream 120 for disposal or more preferably for recirculation.

Cooling fluid exits the lower outlet through a suitable lower conduit 134 which communicates with the outlet 60. A suitable valve such as a needle valve 130 can be positioned so as to control fluid flow through the outlet 60. In the fully open position shown in FIG. 9A, the cooling fluid flows through the valve 130 and conduit 134 such that a lower exiting stream 124 can be removed from the cooling chamber 24. The container is positioned by the upwardly and downwardly flowing fluid fully within the cavity 52 of the cooling chamber 24. When the valve 130 is fully open there can be a movement of the can downward, following a preferential flow towards the bottom of the inlet. If the valve 130 is partially closed as shown in FIG. 9B, fluid flow through the lower outlet 60 is restricted. There is an increased fluid flow in the upward direction through the open top 56, which results in a net upward force signified by arrow 138 on the container such that the container 100 moves up in the cavity 52 of the cooling chamber 24. The partial closing of the valve 130 stabilizes the container (no up or down movement). The amount of restriction required for stability depends usually on the weight and size of the container. The lighter the container the smaller the restriction required on the downward flow for it to go up the chamber. The heavier the container, the more flow through the bottom outlet must be restricted so that the container is stabilized in the middle of the chamber.

Figure 9A:
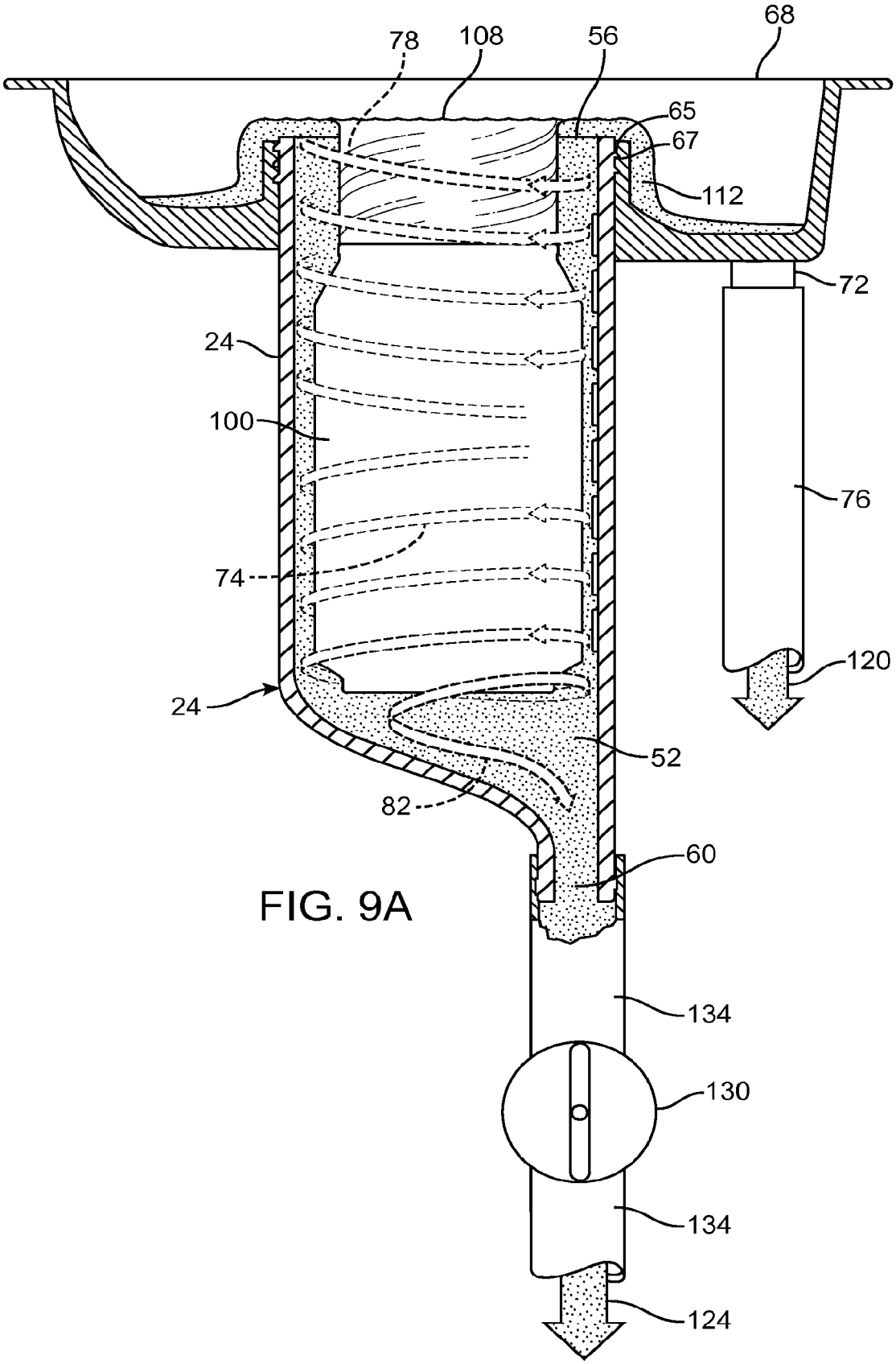
FIGS. 9 A-C are cross sections illustrating fluid flows through the cooling apparatus under conditions of A) a fully open lower valve; B) a partially open lower valve; and C) a closed lower valve.
Figure 9B:
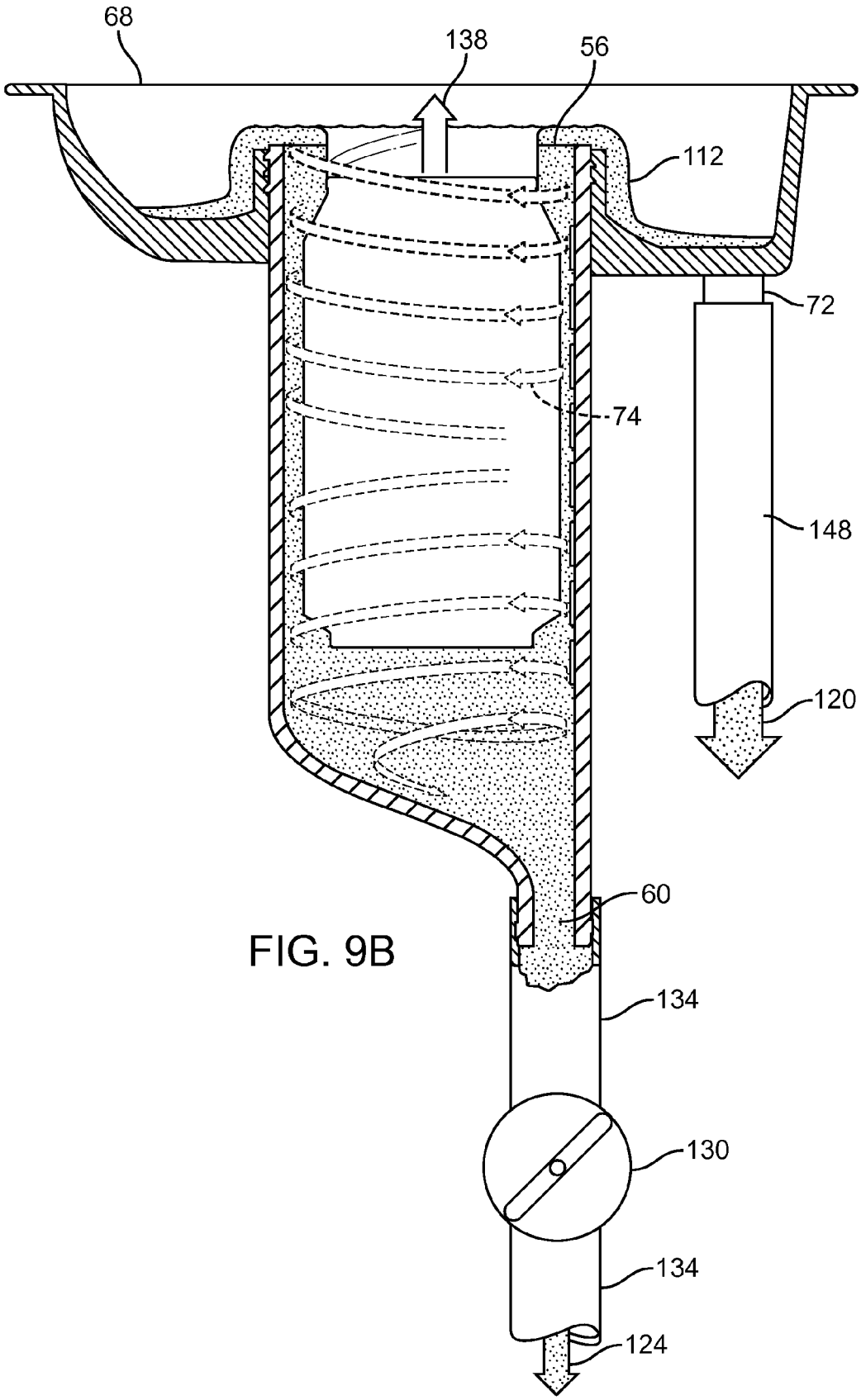
Figure 9C:
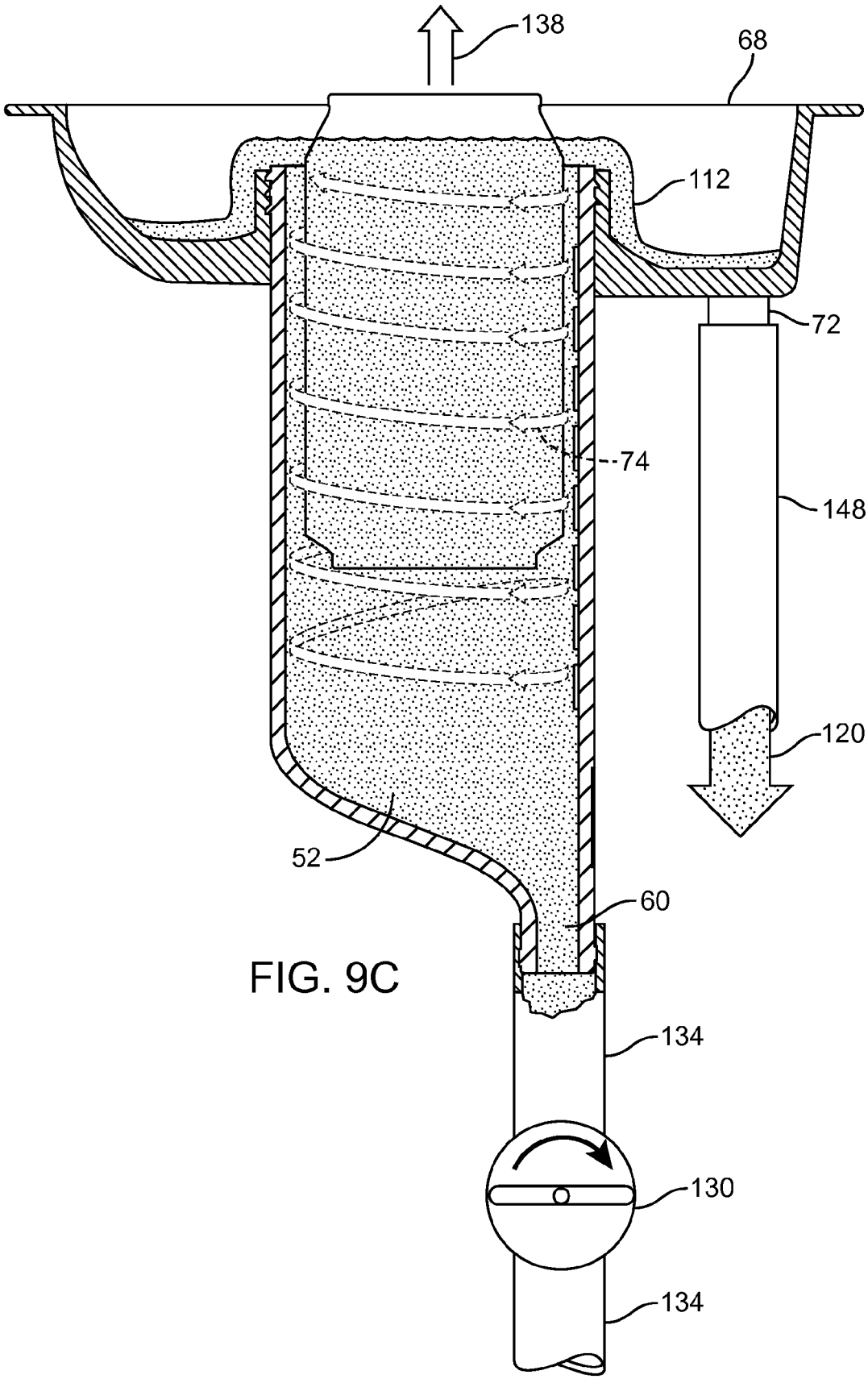

In the fully closed position of the valve 130 shown in FIG. 9C, flow through the lower outlet 60 ceases. All cooling fluid must exit through the open top, which creates a more substantial upward force 138 on the container 100. This causes the container 100 to move further upward in the cavity 52, and to even partially exit the open top 56. The container can then be easily removed from the cooling chamber and replaced with another container to be chilled. Adjustment of the valve 130 can be used to position the container within the cavity 52. The valve can be intermittently opened and closed to cause an additional up-down reciprocating motion, which can contribute to the mixing of the contents of the container, and thus increasing the cooling/heating efficiency.

If the cooling fluid is a liquid that does not need to be under pressure, the flow of coolant does not have to be interrupted during the insertion or extraction of the vessel from the cooling chamber as the valve 130 can be adjusted to permit insertion and extraction.

Figure 10:
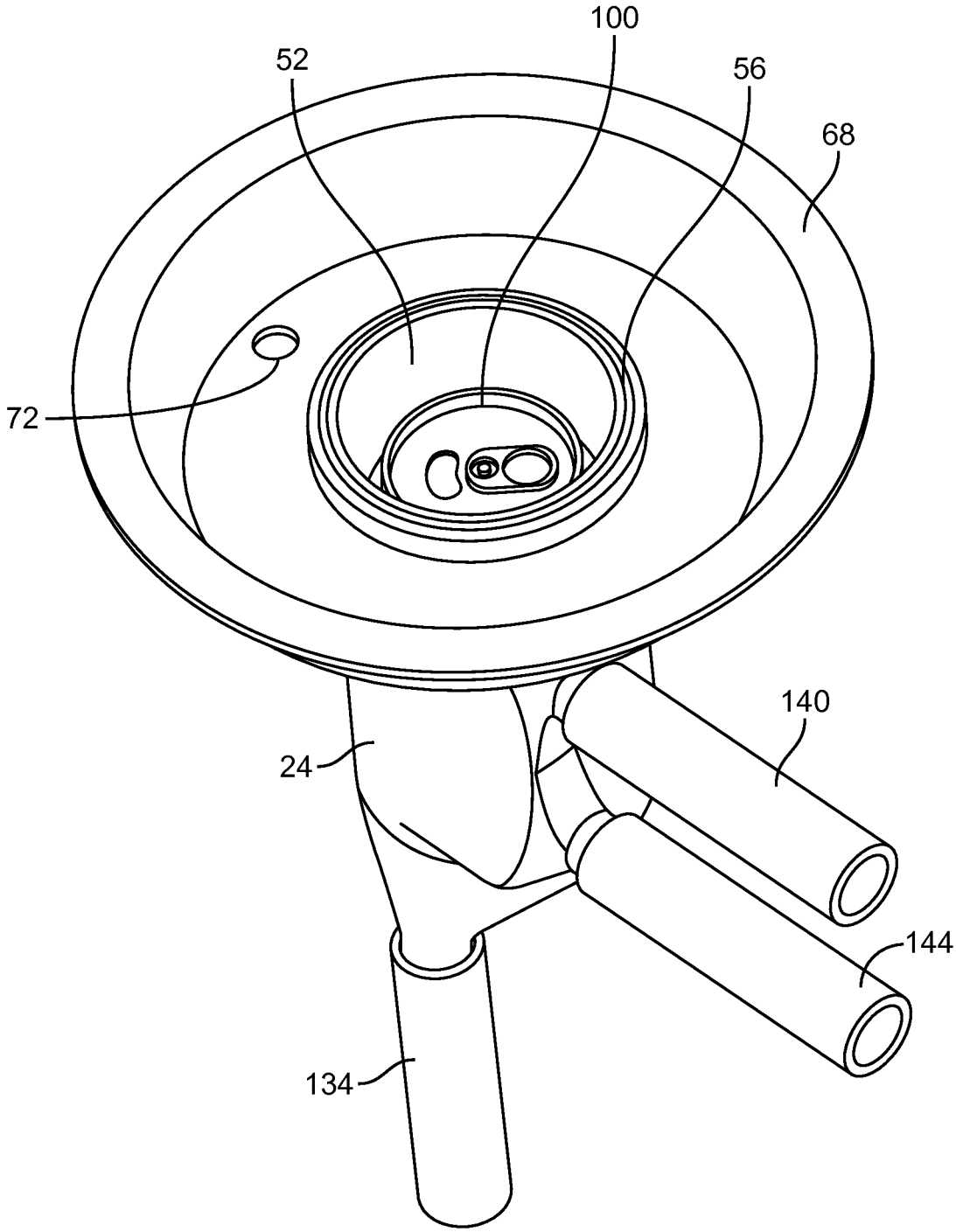
FIG. 10 is a perspective view of the cooling apparatus having a container therein.
Figure 11:
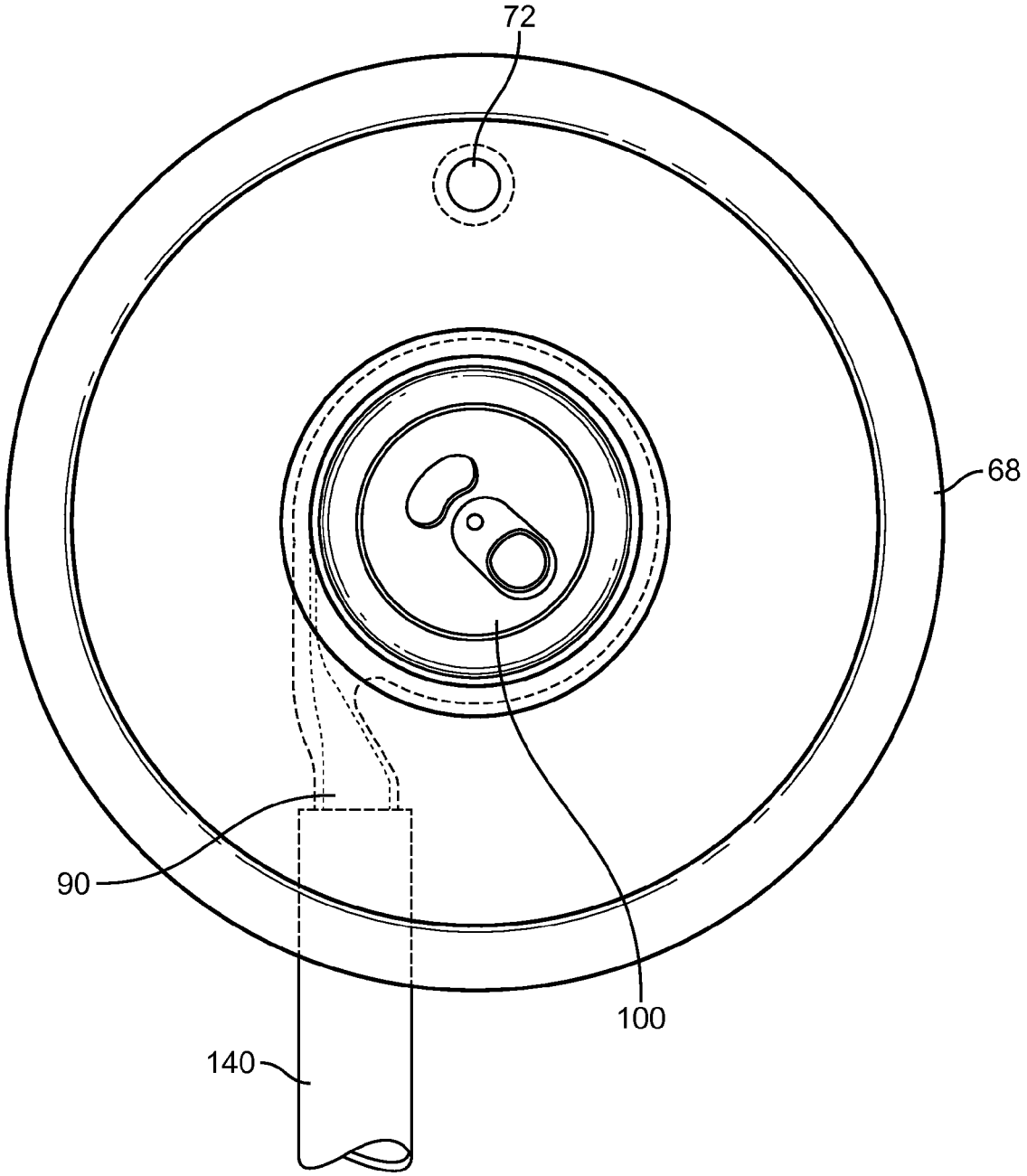
FIG. 11 is a plan view of a cooling apparatus with a container therein.

The cooling chamber 24 with or without the catchment container 68 can be provided as a standalone unit that can be connected to suitable cooling fluid conduits 140 and 144, and outlet conduits such as the outlet conduits 134 and 148, as shown in FIGS. 10-11. Different sizes of cooling chambers 24 can be provided for different sizes of containers 100. The cooling chamber 24 and catchment container 68 can be detachable.

The cooling chamber 24 can have suitable attachment structure such as threads 65 and the catchment container 68 can have cooperating threads 67 such that the catchment container 68 can be attached and detached from the cooling chamber 24 (FIG. 9A). It is possible to integrate cooling chambers according to the invention with other devices, for example, refrigerators which can be used to supply the cooling fluid to the cooling chamber.

Figure 12:
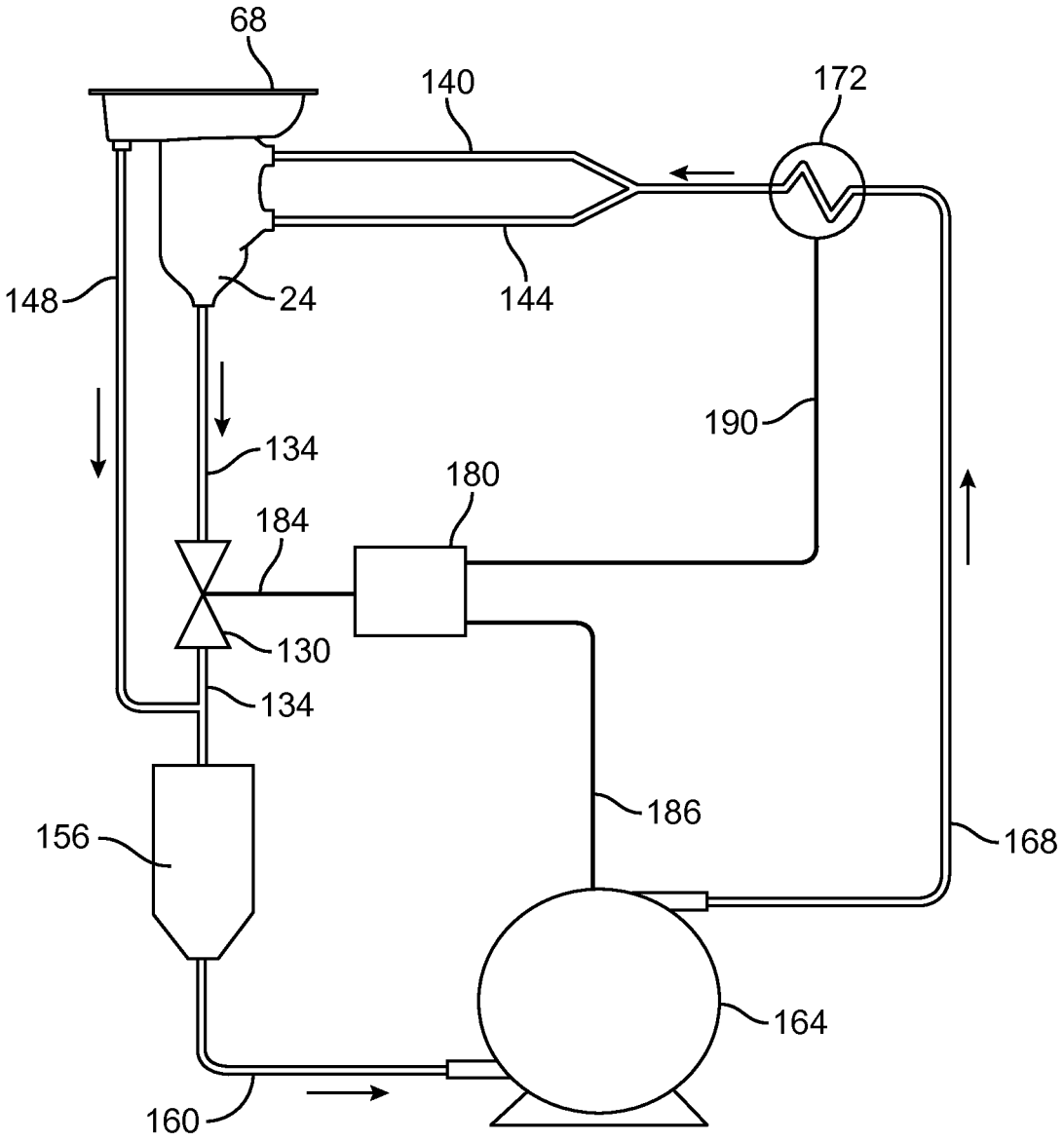
FIG. 12 is a flow diagram of a system for cooling containers according to the invention.

The cooling fluid can be drawn from a large reservoir but is preferably recirculated and re-cooled if necessary. A system for chilling containers is shown in FIG. 12. Cooling fluid flows from the cooling chamber 24 through the lower outlet conduit 134 and from the catchment container 68 through the outlet conduit 148. Flow through the lower outlet conduit 134 can be controlled by the valve 130. Cooling fluid can flow from the lower outlet conduit 134 and the outlet conduit 148 to a cooling fluid reservoir 156. Cooling fluid flows from the reservoir 156 to a pump 164. Cooling fluid exiting the pump 164 is directed to a heat exchanger 172 or other suitable refrigeration unit which cools the cooling fluid. The cooling fluid is then directed to the inlet conduits 140 and 144 and to the cooling chamber 24. Other flow circuits are possible. The system can be controlled by a suitable controller 180, which can be a computer, a programmable logic controller, or other suitable control device. Control lines can be wired or wireless. A control line 184 can be used to control the valve 130, a control line 186 can be used to control the pump 164, and a control line 190 can be used to control the refrigeration or heat exchange unit 172. The flow rate and temperature of the cooling fluid can be controlled and also adjusted by the use of temperature and flow rate sensors to supply data to the controller 180. The controller 180 can also be programmed to perform cyclic or staged cooling operations according to suitable programming.

Figure 13:
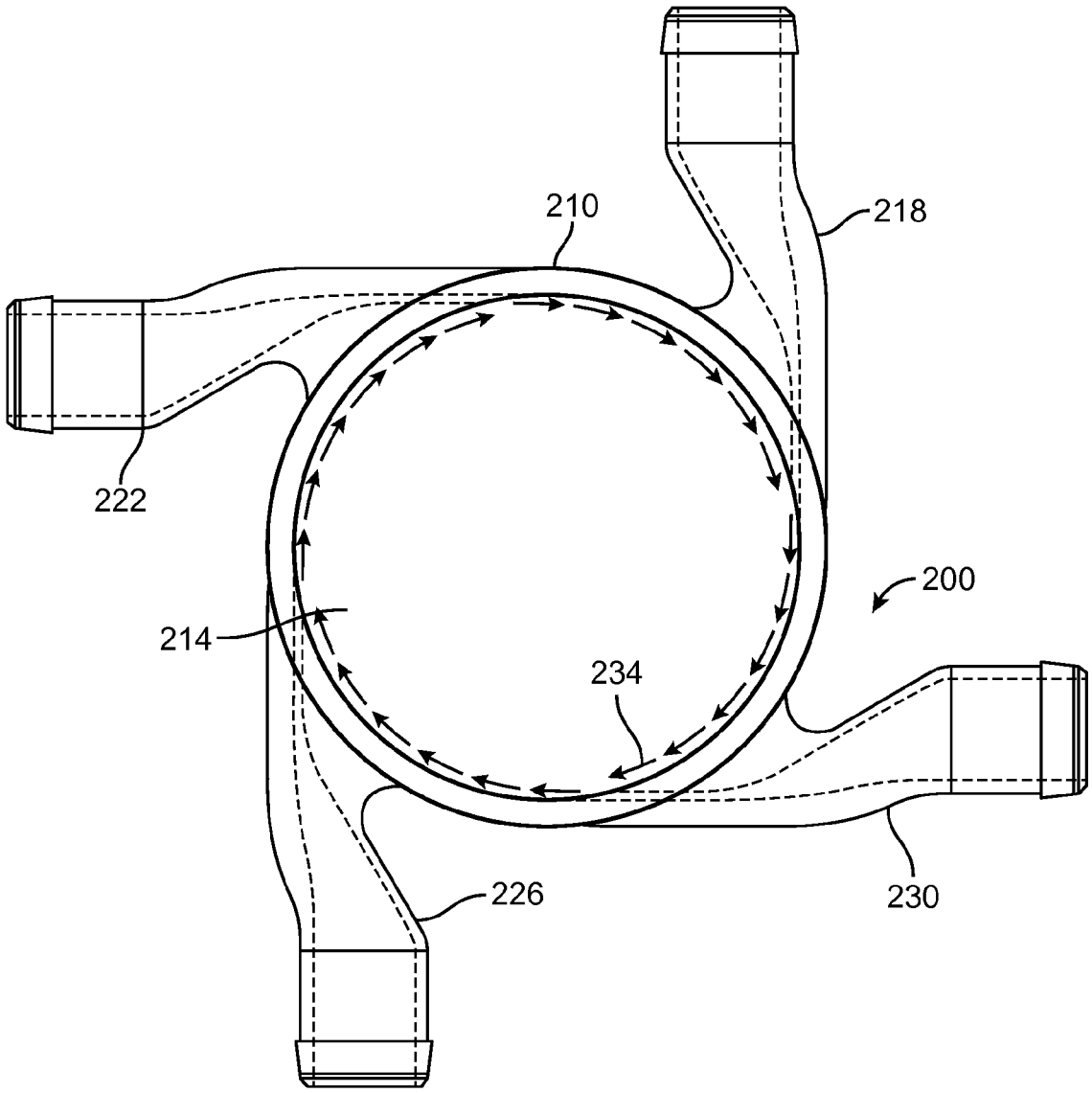
FIG. 13 is a plan view, partially in phantom, of an alternative embodiment of a cooling chamber and illustrating fluid flows through the cooling chamber.

An alternative cooling chamber 200 is shown in FIG. 13. The cooling chamber 200 can have a circular side wall 210 defining a cylindrical cavity 214. Inlet ports 218, 222, 226, and 230 can be provided at different radial positions of the circular side wall 210, such that the rotating container is contacted by fluid flow 234 leaving the inlets at several radial positions as it rotates. Such radially spaced inlets can be provided at several levels along the length of the cooling chamber 200 such that cooling fluid is supplied both vertically and radially to the container.

The components of the system such as the cooling chamber 24, catchment container 68, and other components can be made of any suitable material. Such materials include plastic, metal, glass, or any other materials compatible with the cooling fluid.

Although the invention has been described with respect to cooling containers, it should be understood that the principles disclosed herein are also applicable to heating containers. The cooling fluid in such a case would be replaced by a heating fluid, and the heat transfer imparted to the container by the invention would be heating rather than cooling. For purposes of nomenclature in this application the term cooling fluid also encompasses such heating fluids. In this case, the invention could be used to heat canned foodstuffs such as soups and other canned foods.

The invention generates a uniform rotation of the container in one direction (clockwise or counterclockwise), in an axis parallel to the central axis of the interior cavity 52, but not necessarily collinear to this axis. An offset of this axis may generate additional forces, beneficial to the thermodynamic process, and still not create significant disturbance of the contents of the container. The term parallel as used herein means that the axis of rotation of the container, when taken against the central axis of the interior cavity 52, is no more than ±1, ±2, ±3, ±4, ±5, ±10, ±15, ±20, ±25, or ±30 degrees.

It should be understood that the embodiments and examples described herein are for illustrative purposes and that various modifications or changes in light thereof will be suggested thereby and are to be included within the spirit and purview of this application. The invention can take other specific forms without departing from the spirit or essential attributes thereof.

I claim:

1. An apparatus for cooling a containers with a cooling fluid, comprising:

a cooling chamber having a side wall with a circular interior surface defining a cylindrical interior chamber cavity, the interior chamber cavity having a diameter and length sufficient to receive the container therein, and an open top permitting insertion of the container and egress of the fluid from the top of the cooling chamber;

at least one fluid inlet positioned along the length so as to inject a cooling fluid tangential to the circular side wall at a plurality of different positions of the length of the side wall of the cooling chamber, whereby the container will be suspended in the cooling chamber and rotated and cooled;

at least one normally-open lower fluid outlet at a bottom portion of the cooling chamber for removing cooling fluid from the bottom portion of the cooling chamber.

2. The apparatus of claim 1, wherein the cooling chamber is cylindrical and a plurality of fluid inlets are disposed along a length of the cooling chamber.

3. The apparatus of claim 2, wherein the plurality of inlets are substantially vertically aligned.

4. The apparatus of claim 3, further comprising at least one input manifold for supplying cooling fluid to the plurality of inlets.

5. The apparatus of claim 1, wherein the cooling chamber is cylindrical.

6. The apparatus of claim 1, further comprising a fluid valve in fluid communication with the lower outlet for controlling the flow rate of fluid through the lower outlet.

7. An apparatus for cooling containers, comprising:

a cooling chamber having a side wall with a circular interior surface defining a cylindrical interior chamber cavity, the interior chamber cavity having a diameter and length sufficient to receive the container therein, and an open to permitting insertion of the container and egress of the fluid;

at least one fluid inlet positioned so as to inject a cooling fluid tangential to the circular side wall;

at least one fluid outlet for removing the cooling fluid from the cooling chamber; and, further comprising a catchment container for collecting fluid from the open topped fluid outlet, and dispensing the fluid through at least one catchment outlet.

8. The apparatus of claim 1, further comprising at least one cooling fluid reservoir.

9. The apparatus of claim 1, further comprising at least one fluid pump.

10. The apparatus of claim 1, further comprising a heat exchanger for altering the temperature of the cooling fluid.

11. The apparatus of claim 1, further comprising a controller for controlling at least one of the flow rate of cooling fluid through the fluid inlet and the flow rate of fluid through the fluid outlet.

12. A method for cooling a containers with a cooling fluid, comprising the steps of:

placing the container in a cooling chamber having a circular side wall defining an interior chamber cavity, the interior chamber cavity having a diameter and length sufficient to receive the container therein, and an open top permitting insertion of the container and egress of the fluid from the top of the cooling chamber;

injecting a cooling fluid into the cooling chamber tangentially to the circular side wall at a plurality of different positions of the length of the side wall of the cooling chamber;

contacting the container with the cooling fluid to suspend, rotate and cool the container within the cooling chamber;

removing the cooling fluid from the open top of the cooling chamber and also from a normally-open lower fluid outlet in a bottom portion of the cooling chamber while the container is suspended and rotating within the cooling chamber.

13. The method of claim 12, further comprising the step of closing the normally-open lower fluid outlet in the bottom portion of the cooling chamber while continuing to inject cooling fluid into the cooling chamber, so as to eject the suspended container from the cooling chamber through the open top.

14. The method of claim 12, wherein flow through the normally-open lower fluid outlet is controlled by an adjustable valve, and further comprising the step of controlling flow through the valve to adjust the position of the suspended container within the cooling cavity.

* * * * *